US009549266B2

(12) United States Patent
Feilner et al.

(10) Patent No.: US 9,549,266 B2
(45) Date of Patent: Jan. 17, 2017

(54) METHOD OF CONTROLLING A HEARING INSTRUMENT

(75) Inventors: Manuela Feilner, Herrliberg (CH); Martin Kuster, Oetwil am See (CH)

(73) Assignee: SONOVA AG, Staefa (CH)

( * ) Notice: Subject to any disclaimer, the term of this patent is extended or adjusted under 35 U.S.C. 154(b) by 101 days.

(21) Appl. No.: 14/396,442

(22) PCT Filed: Apr. 24, 2012

(86) PCT No.: PCT/EP2012/057464
§ 371 (c)(1),
(2), (4) Date: Oct. 23, 2014

(87) PCT Pub. No.: WO2013/159809
PCT Pub. Date: Oct. 31, 2013

(65) Prior Publication Data
US 2015/0110313 A1 Apr. 23, 2015

(51) Int. Cl.
*H04R 25/00* (2006.01)
*G10L 21/02* (2013.01)

(52) U.S. Cl.
CPC ..... *H04R 25/50* (2013.01); *H04R 25/407* (2013.01); *H04R 25/552* (2013.01); *G10L 21/02* (2013.01);
(Continued)

(58) Field of Classification Search
CPC ..... H04R 3/005; H04R 25/60; H04R 25/65; H04R 25/70; H04R 25/356; H04R 25/402; H04R 25/405; H04R 25/407; H04R 25/505; H04R 25/552; H04R 25/554; H04R 25/558; H04R 25/604; H04R 25/652; H04R 25/658; H04R 2225/41
(Continued)

(56) References Cited

U.S. PATENT DOCUMENTS 7,319,769 B2 * 1/2008 Allegro-Baumann . H04R 25/70 381/312
8,295,497 B2 * 10/2012 Roeck ..... H04R 25/552 381/312
2013/0054231 A1 * 2/2013 Jeub ..... H04R 3/005 381/94.2

FOREIGN PATENT DOCUMENTS

EP 1 465 456 A2 10/2004
EP 1 670 285 A2 6/2006
WO 2012/007183 A1 1/2011

OTHER PUBLICATIONS

Kuster, "Estimating the Direct-to-reverberant Energy Ration From the Coherence Between Coincident Pressure and Particle Velocity", The Journal of the Acoustical Society of America, American Institute of Physics for the Acoustical Society of America, New York, NY, US, vol. 130, No. 6, Dec. 1, 2011, pp. 3781-3787.
(Continued)

*Primary Examiner* — Brian Ensey
(74) *Attorney, Agent, or Firm* — Pearne & Gordon LLP

(57) ABSTRACT

Method of controlling a hearing instrument comprising at least one hearing device, the method comprising determination of an acoustic environment at least partially by means of calculating the complex coherence of signals from either a pressure microphone and a particle velocity transducer; a pair of pressure microphones in a single hearing device; or a pair of pressure microphones, one situated in each of a pair of hearing devices. This enables finer determination of acoustic environments, thus improving the hearing experience for the wearer of the hearing instrument.
The invention further relates to a corresponding hearing instrument.

28 Claims, 5 Drawing Sheets

(52) U.S. Cl.
CPC ..... *H04R 2225/41* (2013.01); *H04R 2225/43* (2013.01); *H04R 2410/01* (2013.01)

(58) Field of Classification Search
USPC ..... 381/312, 313, 314, 315, 322, 326, 327, 381/328, 330
See application file for complete search history.

(56) References Cited

OTHER PUBLICATIONS

International Search Report for PCT/EP2012/057464 dated Jan. 16, 2013.
Written Opinion for PCT/EP2012/057464 dated Jan. 16, 2013.

* cited by examiner

METHOD OF CONTROLLING A HEARING INSTRUMENT

BACKGROUND

The present invention relates to a method of controlling a hearing instrument based on identifying an acoustic environment, and a corresponding hearing instrument.

It is common for state-of-the-art hearing instruments to incorporate automatic control of actuators such as noise cancellers, beam formers, and so on, to automatically adjust the hearing instrument to optimise the sound output for the wearer dependent on the acoustic environment. Such automatic control is based on classifying types of acoustic environments into broad classes, such as "clean speech", "speech in noise", "noise", and "music". This is typically achieved by processing sound information from a microphone and extracting characteristic features of the sound information, such as energy spectrums, frequency responses, signal-to-noise ratios, signal directions, and so on. Based on the result of the extraction of characteristic features, parameters of the audio signal processing unit are adjusted to optimise the wearer's hearing experience in his or her present surroundings. This optimisation can be by means of predefined programs, or adjusting individual parameters as required.

With various prior art systems, there are several limitations: the detectable classes of acoustic environments are rather broad, leading to insufficient hearing performance for some specific hearing scenarios; extra hardware is often required, increasing costs, power consumption and complexity; and many of the prior art solutions rely on real-time communication between hearing devices and sometimes also a beacon or other separate module that has to be carried by the wearer. Real-time communication uses a lot of power, leading to short battery life and frequent battery changes.

SUMMARY OF INVENTION

Certain acoustic environments can be problematic for prior art hearing instruments, such as:

1. Driving a Car

While driving a car, different noises occur. E.g. the machine noise of the motor varies considerably, depending on the acceleration or speed of the car. This leads to a "nervous" behaviour of prior art hearing instruments, since the Noise Canceler (NC) is activated in and out. Also the main noise has the character of low frequencies, whereas important feedback signals of the car or of the traffic have the character of higher frequencies.

While communicating to a passenger in the car, the speech does not arrive from the front. The passenger's voice typically arrives from the side or from the back. The state-of-the art reaction of the HI is activating the Beam former (BF), which decreases the speech intelligibility.

2. Quiet at Home

In quiet situations at home, e.g. the humming of the fridge or air conditioning system is amplified by prior art hearing instruments, and disturbs the wearer. Also, the rustling of newspaper or noises from the neighbour can disturb the wearer while performing a quiet activity at home, such as reading.

3. Quiet in Nature

In contrast to the "quiet at home" scenario above, most of the end-users want to listen every little event while they are in nature and observing e.g. birds. In such a situation it is advantageous to enhance soft sounds, whereas in the "quiet at home" situation it is advantageous to diminish soft sounds.

As a result, it is beneficial to distinguish between "quiet at home" and "quiet in nature", which is not possible to perform reliably with prior art hearing instruments.

4. Watching TV

A TV broadcasts audio signals with high variety in short time. The state-of-the art classification tries to follow the audio signal changes and makes prior art hearing instrument behaviour appear "nervous", frequently switching modes. In addition, the most important class "speech in noise" does not assist in speech intelligibility on a TV signal, since the target and the noise signal are coming from the same direction.

It is thus desirable for the TV signal to be detected as a TV signal, so that the hearing device could for instance launch a program with suitable constant actuator settings, or distinguish only between "understanding speech" and "listening to music".

It is thus advantageous to be able to distinguish at least the above-mentioned scenarios and thereby increase the overall number of acoustic environments that can be automatically determined.

The object of the present invention is thus to overcome at least one of the above-mentioned limitations of the prior art.

In the context of the invention, by hearing instruments we understand hearing aids, which may be situated in the ear, behind the ear, or as cochlea implants, active hearing protection for loud noises such as explosions, gunfire, industrial or music noise, and also earpieces for communication devices such as two-way radios, mobile telephones etc. which may communicate by Bluetooth or any other protocol. A hearing instrument may comprise one single hearing device (e.g. a single hearing aid), two hearing devices (e.g. a pair of hearing aids either acting independently or linked in a binaural system, or a single hearing aid and an external control unit), or three or more hearing devices (e.g. a pair of hearing aids as previously, combined with an external control unit).

This is achieved by a method of controlling a hearing instrument comprising at least one hearing device, the method comprising the steps of:

- receiving sound information with at least a first transducer and a second transducer, for instance a first and a second microphone (which may be situated in the same or different hearing devices—see below), or a pressure transducer and a particle velocity transducer;
- processing said sound information, e.g. in a (data) processing unit, so as to extract at least one characteristic feature of the sound information, this characteristic providing useful information as to what class of acoustic environment is being experienced by the hearing instrument wearer;
- determining a type of acoustic environment selected from a plurality of predefined classes of acoustic environment based on the at least one extracted characteristic feature;
- adjusting sound processing parameters, e.g. of a signal processing unit, based on the determined type of acoustic environment, which optimises the hearing experience of the wearer of the hearing instrument, the sound processing parameters defining an input/output behavior of the at least one hearing device and controlling, for instance, active beamformers, noise cancellers, filters and other sound processing;

wherein the at least one characteristic feature comprises a complex coherence calculated based on the sound information received by the first transducer and the second transducer.

Complex coherence is calculated in its most generic form as (equation 1):

$$\gamma_{XY} = \frac{(XY^*)}{\sqrt{(XX^*)(YY^*)}}$$

wherein X and Y are functions, $\gamma_{XY}$ is the complex coherence between the two functions, and asterisks denote complex conjugates of the relevant functions. For simplicity, frequency dependence has been omitted from the above equation. Using complex coherence calculated based on sound information received by the first and second transducer, many more classes of acoustic environments can be distinguished than with previous methods, particularly when used in addition to existing methods as an extra characteristic enabling refinement of the determination of the acoustic environment. Since the complex coherence is a single complex number (or a single complex number per desired frequency band if calculating in frequency bands), computation utilising it is extremely fast and simple.

In an embodiment, the first transducer is a pressure microphone and the second transducer is a particle velocity transducer, which may be of any type, both being situated in the same hearing device in an acoustically-coincident manner, i.e. no more than 10 mm, better no more than 4 mm apart, and the complex coherence is calculated based on the sound pressure measured by the pressure microphone and the particle velocity measured by the particle velocity transducer, these two transducers being situated in the same hearing device, i.e. one individual hearing device. In this case, the complex coherence is computed as (equation 2):

$$\gamma_{PU} = \frac{(PU^*)}{\sqrt{(PP^*)(UU^*)}}$$

wherein P is the sound pressure at the pressure microphone and U is the particle velocity measured by the particle velocity transducer. Both signals are in the frequency domain. Angled brackets indicate an averaging procedure necessary for the calculation of the coherence from discrete time and finite duration signals, such as the well-known Welch's Averaged Periodogram. The time frames for the averaging would typically be between 5 ms and 300 ms long, and should be smaller than the reverberation time in the rooms to be characterised.

This has the particular advantage of giving accurate results, since the particle velocity is measured directly.

In an embodiment, the particle velocity transducer is a pressure gradient microphone, or hot wire particle velocity transducer. This gives concrete forms of the particle velocity transducer.

In an alternative embodiment, the first transducer is a first pressure microphone i.e. an omnidirectional pressure microphone, and the second transducer is a second pressure microphone, which may likewise be an omnidirectional pressure microphone. This enables utilisation of current transducer layouts.

In an embodiment, these two microphones are situated in the same hearing device, e.g. integrated in the shell of one hearing device, in which case the complex coherence is calculated using equation 2 as above, however with the following substitutions (equation 3):

$$P = \frac{P_1 + P_2}{2}$$

wherein P is the mean pressure between the sound pressure at the first and second microphones ($P_1$ and $P_2$ respectively), and (equation 4a):

$$U = \frac{1}{\rho_0 c}\frac{P_1 - P_2}{jk\Delta x}$$

or (equation 4b):

$$U = \frac{P_1 - P_2}{j\omega\rho_0\Delta x}$$

wherein U is the particle velocity, $P_1$ and $P_2$ are the sound pressure at the first and second microphones respectively, k is the wave number, c is the speed of sound in air, $\rho_0$ is the mass density of air, $\omega$ is the angular frequency, j is the square root of −1, and $\Delta x$ is the distance between the first and second pressure microphones.

This embodiment enables the advantages of the invention to be applied to pre-existing dual-microphone hearing devices, such as hearing devices incorporating adjustable beamforming function.

In an alternative embodiment incorporating two pressure microphones, each microphone is situated in a different hearing device, i.e. one in a first hearing device (e.g. a first hearing aid) and one in a second hearing device (e.g. a second hearing aid), the combination of the first and second hearing devices forming at least part of the hearing instrument, in which case the complex coherence is calculated as (equation 5):

$$\gamma_{P_1P_2} = \frac{(P_1P_2^*)}{\sqrt{(P_1P_1^*)(P_2P_2^*)}}$$

wherein $P_1$ is sound pressure at the first transducer and $P_2$ is the sound pressure at the second transducer.

This can advantageously be incorporated into existing binaural hearing instruments with a single microphone (or multiple microphones) on each individual hearing device.

In an embodiment, since information is required to be exchanged between the two hearing devices, the first and second hearing devices send and/or receive signals relating to the received sound information to/from the other hearing device, thus enabling the complex coherence between $P_1$ and $P_2$ as above to be calculated.

In an embodiment, data is exchanged between a first processing unit in the first hearing device and the second processing unit in the second hearing device.

In an embodiment, digitised signals corresponding to sound information received at each microphone is exchanged between each hearing device, the signals corresponding to sound information in either the time domain or the frequency domain. This provides the processing unit in each hearing device with full information.

Alternatively, digitised signals corresponding to sound information at one microphone are transmitted from the second hearing device to the first hearing device, and signals corresponding to commands for adjusting sound process parameters are transmitted from the first hearing device to the second hearing device. This enables calculation of the complex coherence (and optionally other characteristic features) in a single hearing device, the resulting commands for adjusting sound process parameters being transmitted back to the other hearing device.

Alternatively, one hearing device processes sound information for determining the complex coherence in a first frequency band, e.g. low-frequency, and the other hearing device processes sound information in a second frequency band, e.g. high-frequency. In this case, the sound information in the respective frequency ranges is transmitted to the other hearing device, and the result of the processing is transmitted back. This enables the calculation of the complex coherence to be performed without redundancy: the first hearing device thereby calculates the complex coherence in the first frequency band (e.g. low frequency), and the second hearing device calculates the complex coherence in the second frequency band (e.g. high-frequency), the two hearing devices mutually exchanging the sound information required for their respective calculations, and the results of their respective calculations.

In an embodiment, the characteristic features further comprise at least one of: signal-to-noise ratio in at least one frequency band; signal-to-noise ratio in a plurality of frequency bands; noise level in at least one frequency band; noise level in a plurality of frequency bands; direction of arrival of noise signals; direction of arrival of useful signal; signal level; frequency spectra; modulation frequencies; modulation depth; zero crossing rate; onset; center of gravity; RASTA, etc.

This enables the present invention to improve on the resolution of the classification of acoustic environments that can be distinguished.

In combination with any of the above embodiments, the complex coherence may be calculated in a single frequency band, e.g. encompassing the entire audible range of frequencies (normally considered as being 20 Hz to 20 kHz), which is simple, or, for more accuracy and resolution, the complex coherence may be calculated in a plurality of frequency bands spanning at least the same frequency range. In an embodiment, the plurality of frequency bands has a linear resolution of between 50 Hz and 250 Hz or a psychoacoustically-motivated non-linear frequency resolution, such as octave bands, Bark bands, other logarithmically arranged bands, etc. as known in the literature. Incorporating a frequency-dependence enables significantly increased discernment of various acoustic environments, as will be illustrated later.

The above-mentioned method embodiments may be combined in any non-contradictory manner.

The invention further concerns a hearing instrument comprising at least one hearing device; a least a first transducer and a second transducer; at least one processing unit (which could be multiple processing units in one or more hearing devices, arranged as convenient) operationally connected to first transducer and the second transducer; an output transducer operationally connected to an output of the least one processing unit, wherein the at least one processing unit comprises means for processing sound information received by the first transducer and the second transducer so as to extract at least one characteristic feature of the sound information; means for determining a type of acoustic environment selected from a plurality of predefined classes of acoustic environment based on the at least one extracted characteristic feature; means for adjusting sound processing parameters based on the determined type of acoustic environment, the sound processing parameters defining an input/output behavior of the at least one hearing device and controlling, for instance, active beamformers, noise cancellers, filters and other sound processing; wherein said at least one characteristic feature comprises a complex coherence calculated based on the sound information received by the first transducer and the second transducer. As above, using complex coherence calculated based on sound information received by the first and second transducer, many more classes of acoustic environments can be distinguished than with previous methods, particularly when used in addition to existing methods as an extra characteristic enabling refinement of the determination of the acoustic environment. Since the complex coherence is a single complex number (or a single complex number per desired frequency band if calculating in frequency bands), computation utilising it is extremely fast and simple.

In an embodiment, the first transducer is a pressure microphone and the second transducer is a particle velocity transducer, both being situated in the same hearing device in an acoustically-coincident manner, i.e. no more than 10 mm, better no more than 4 mm apart, the complex coherence determined being that of the complex coherence between the sound pressure measured by the pressure microphone and a particle velocity measured by the particle velocity transducer, which may be of any type.

In an embodiment, the particle velocity transducer is a pressure gradient microphone or a hot wire particle velocity transducer. These are concrete examples of such transducers.

In an embodiment, the first transducer is a first pressure microphone, i.e. an omnidirectional pressure microphone, and the second transducer is a second pressure microphone, i.e. likewise an omnidirectional pressure microphone. This enables utilisation of current transducer layouts.

In an embodiment, these two microphones are situated in the same hearing device, e.g. integrated in the shell of one hearing device, in which case the complex coherence is calculated as described above in relation to equations 2, 3, 4a and 4b. This embodiment enables the advantages of the invention to be applied to pre-existing dual-microphone hearing devices, such as hearing devices incorporating beamforming function.

In an alternative embodiment incorporating two pressure microphones, each microphone is situated in a different hearing device, i.e. one in a first hearing device (e.g. a first hearing aid) and one in a second hearing device (e.g. a second hearing aid), the combination of the first and second hearing devices forming at least part of the hearing instrument, in which case complex coherence is calculated as in equation 5 above. This can advantageously be incorporated into existing binaural hearing instruments with a single microphone (or multiple microphones) on each individual hearing device.

In an embodiment, the first and second hearing devices each comprise at least one of a transmitter, a receiver, or a transceiver, for sending and receiving signals as appropriate to and from the other hearing device as appropriate. This enables the transmission and reception of sound information, data, commands and so on between the first and second hearing devices.

In an embodiment, the signals sent between the two hearing devices relate to sound information in either the time domain or the frequency domain. This provides the processing unit in each hearing device with full information.

In an embodiment, above-mentioned signals relate to data exchanged between a first processing unit in the first hearing device and the second processing unit in the second hearing device.

In an embodiment, the second hearing device is arranged to transmit digitised signals corresponding to sound information at one microphone to the second hearing device, and the second hearing device is arranged to transmit signals corresponding to commands for adjusting sound process parameters to the first hearing device, each hearing device being arranged to receive signals transmitted by the contralateral (i.e. the other) hearing device. This enables calculation of the complex coherence (and optionally other characteristic features) in a single hearing device, the resulting commands for adjusting sound process parameters being transmitted back to the other hearing device.

In an embodiment, the first hearing device comprises a first processing unit for processing sound information situated in a first frequency band and the second device comprises a processing unit for processing sound information situated in a second frequency band, wherein each hearing device is arranged to transmit the sound information required by the contra-lateral device via its transmitter or transceiver, and after processing, each hearing device further being arranged to transmit the result of said processing to the contra-lateral hearing device via its transmitter or transceiver, each hearing device being further arranged to receive the signals transmitted by the contra-lateral hearing device by means of its receiver or transceiver. This enables the calculation of the complex coherence to be performed without redundancy: the first hearing device thereby calculates the complex coherence in the first frequency band (e.g. low frequency), and the second hearing device calculates the complex coherence in the second frequency band (e.g. high-frequency), the two hearing devices mutually exchanging the sound information required for their respective calculations, and the results of their respective calculations.

In an embodiment, the characteristic features further comprise at least one of: signal-to-noise ratio in at least one frequency band; signal-to-noise ratio in a plurality of frequency bands; noise level in at least one frequency band; noise level in a plurality of frequency bands; direction of arrival of noise signals; direction of arrival of useful signal; signal level; frequency spectra; modulation frequencies; modulation depth; zero crossing rate; onset; center of gravity; RASTA, etc.

This enables the present invention to improve on the resolution of the classification of acoustic environments that can be distinguished.

In an embodiment, at least one processing unit is arranged to calculate the complex coherence in a single frequency band, e.g. encompassing the entire audible range of frequencies (normally considered as being 20 Hz to 20 kHz), which is simple, or, for more accuracy and resolution, in a plurality of frequency bands spanning at least the same frequency range. In an embodiment, the plurality of frequency bands has a linear resolution of between 50 Hz and 250 Hz, or a psychoacoustically-motivated non-linear frequency resolution, such as octave bands, Bark bands, other logarithmically arranged bands, etc. as known in the literature. This latter enables significantly increased discernment of various acoustic environments, as will be illustrated later.

The above-mentioned hearing instrument claims may be combined in any manner that is not contradictory.

The invention will now be illustrated by means of example embodiments, which are not be considered as limiting, as shown in the following figures:

DETAILED DESCRIPTION OF THE DRAWINGS

In the figures, like components are illustrated with like reference signs.

Figure 1:
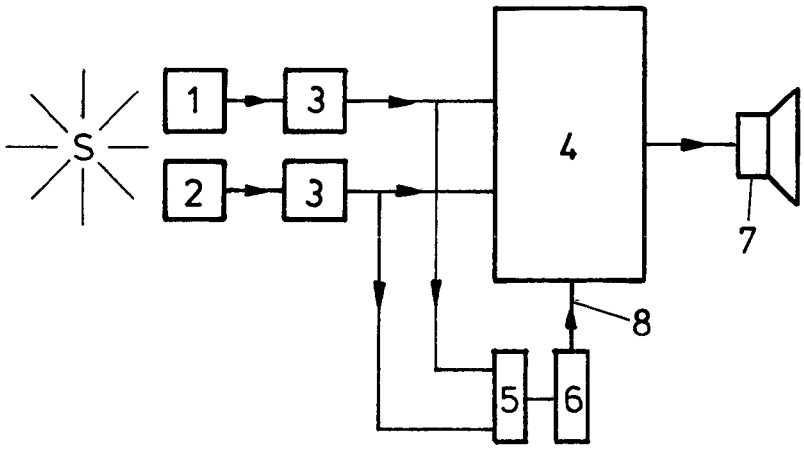
FIG. 1: a block diagram of a first embodiment situated in a single hearing device.

FIG. 1 shows schematically a simple embodiment of a monaural application of the invention, i.e. situated within a single hearing device, e.g. a single hearing aid. A first transducer 1 and a second transducer 2 receive sound S, their outputs being digitised in A-D converters 3. Fast Fourier Transform (FFT) may be applied in A-D converters 3. One information pathway from each A-D converter leads to a signal processing unit 4, which processes the sound information before it is transmitted to a loudspeaker 7, which outputs it as sound. A second information pathway from each A-D converter leads to a data processing unit 5 which extracts the characteristic feature or features, including the complex coherence. The output of data processing unit 5 is then input into the determination unit 6 constituting determining means for determining the class of acoustic environment from a plurality of predefined classes. Determination unit 6 produces commands at 8 for the signal processing unit 4, these commands instructing the signal processing unit to adjust sound processing parameters, e.g. those of noise reducers, beamformers etc. so as to optimise the wearer's hearing experience.

Although signal processing unit 4, data processing unit 5 and determination unit 6 have been illustrated and described as separate functional blocks, they may be integrated into the same processing unit and implemented either in hardware or software. Likewise, they may be divided over or combined in as many functional units as is convenient. This equally applies to all of the below embodiments.

As described above, transducer 1 is a pressure microphone, and transducer 2 may be either a second pressure microphone or a particle velocity transducer such as a pressure gradient microphone, a hot wire particle velocity transducer, or any other equivalent transducer. In each case, the complex coherence is calculated as described above. As a variation, the digitised output of one single transducer (i.e. the/one pressure microphone) may be used as an input for the signal processing unit, the output of both transducers being used for determining the complex coherence and other characteristic features.

Figure 2:
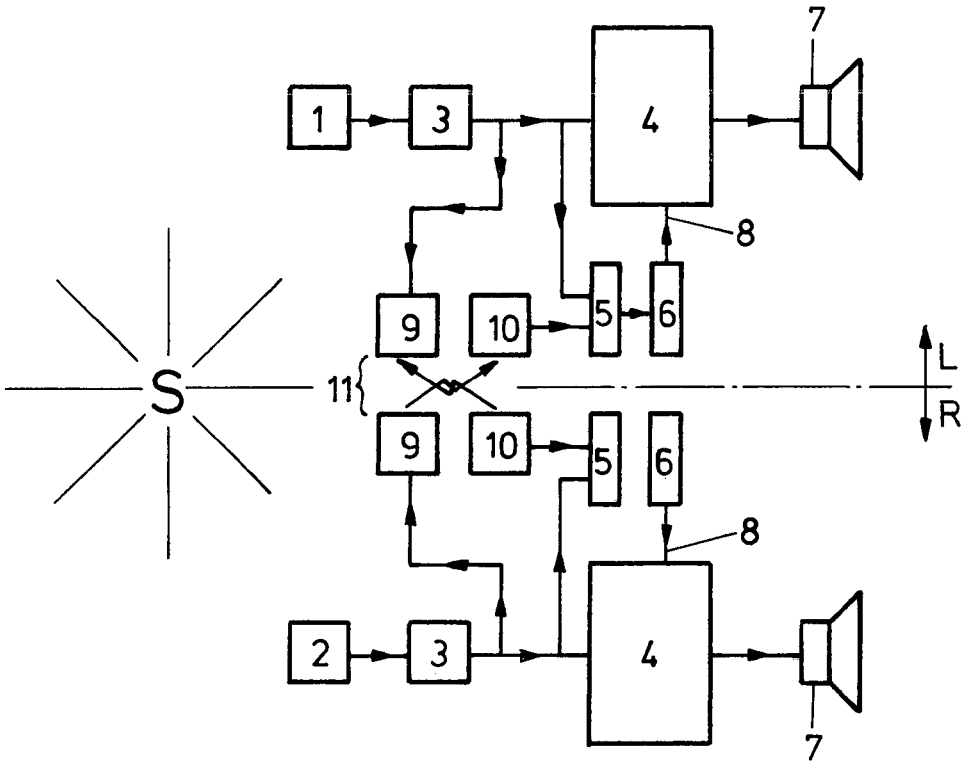
FIG. 2: a block diagram of a second, binaural, embodiment.

FIG. 2 shows a second, binaural, embodiment of an implementation utilising a pair of hearing devices L and R. Each hearing device differs from the single device of FIG. 1 in that only a single transducer (1, 2 respectively), which would normally be an omnidirectional pressure microphone, is present at each hearing device. The digitised signal from each transducer is transmitted by transmitter 9 and received by receiver 10 of the other hearing device over wireless link 11. The signal received by each receiver 10 is used as one input of the data processing unit 5, the other input being the digitised sound information from the transducer situated in the respective hearing device. In this case, the data processing unit calculates, amongst other characteristic features, the PP complex coherence $\gamma_{P1P2}$ (see above) of the sound information received by the two transceivers 1, 2. It is self-evident that transmitter 9 and receiver 10 may be combined into a single transceiver unit in each individual hearing device.

Figure 3:
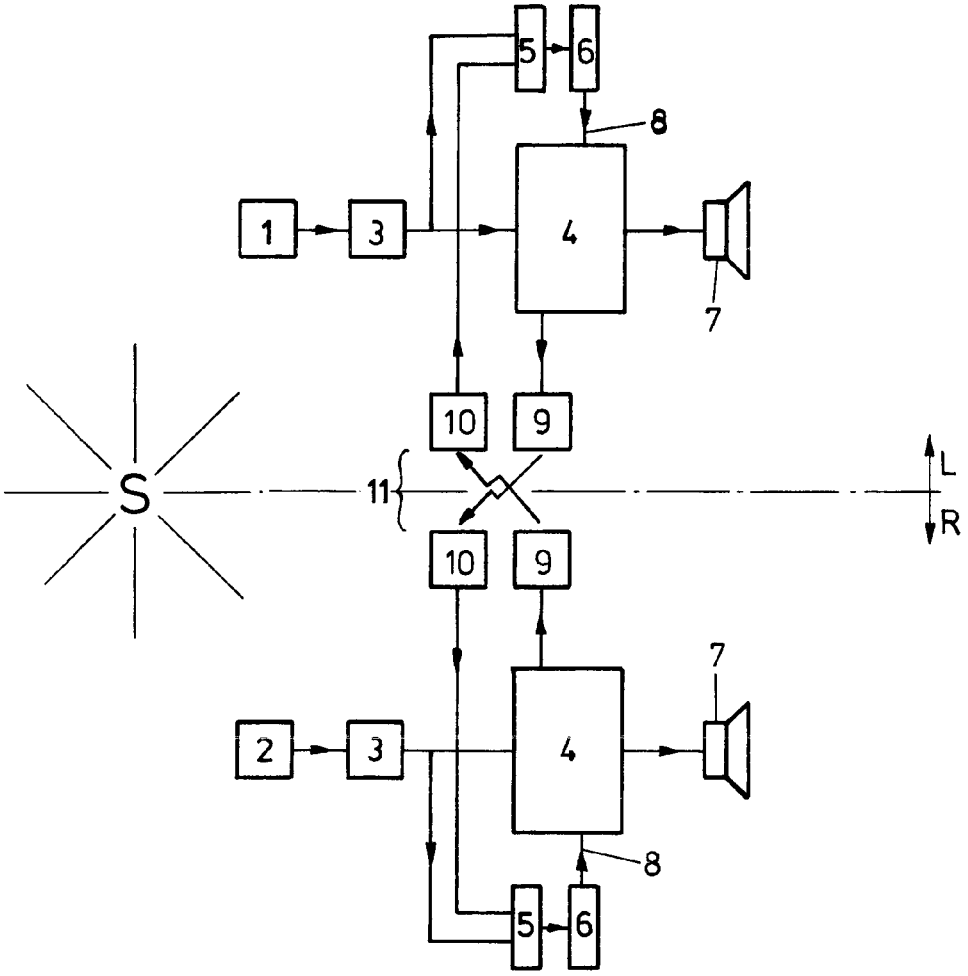
FIG. 3: a block diagram of a third, binaural, embodiment.

FIG. 3 shows a third, binaural, embodiment of an implementation of the invention which differs from the embodiment of FIG. 2 in that the signals transmitted over the wireless link 11 between the two individual hearing devices originate in the signal processing unit 4. This permits a degree of postprocessing to be carried out by signal processing units 4 before transmission of the sound information to the other hearing device. As in FIG. 2, transmitter 9 and receiver 10 may be combined into a single transceiver unit.

Figure 4:
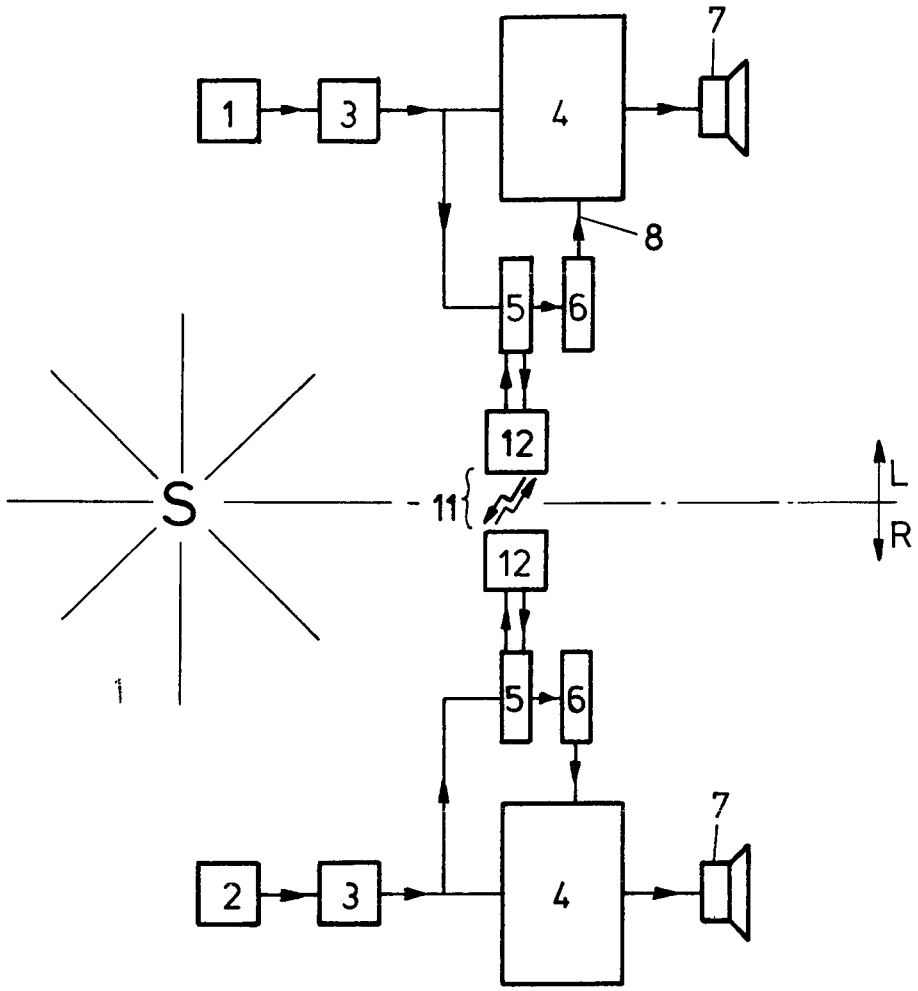
FIG. 4: a block diagram of a fourth, binaural, embodiment.

FIG. 4 shows a fourth, binaural, embodiment of an implementation of the invention which differs from the embodiments of FIG. 2 and FIG. 3 in that, rather than exchange sound data directly or after processing by the signal processing unit 4 over wireless link 11, data processing units 5 exchange sound information data directly via transceivers 12 over the wireless link 11. This sound information data is then used by the data processing units 5 to calculate the complex coherence between the sound pressure at each microphone 1, 2, as well as the other characteristic features. In place of transceivers 12, separate transmitters and receivers may be utilised as in the embodiments of FIGS. 2 and 3. The sound information data transmitted between the data processing units 5 may be either in time domain or in frequency domain, as convenient.

This embodiment is particularly suited for a type of distributed processing, for which the data processing unit 5 can be utilised.

Figure 5:
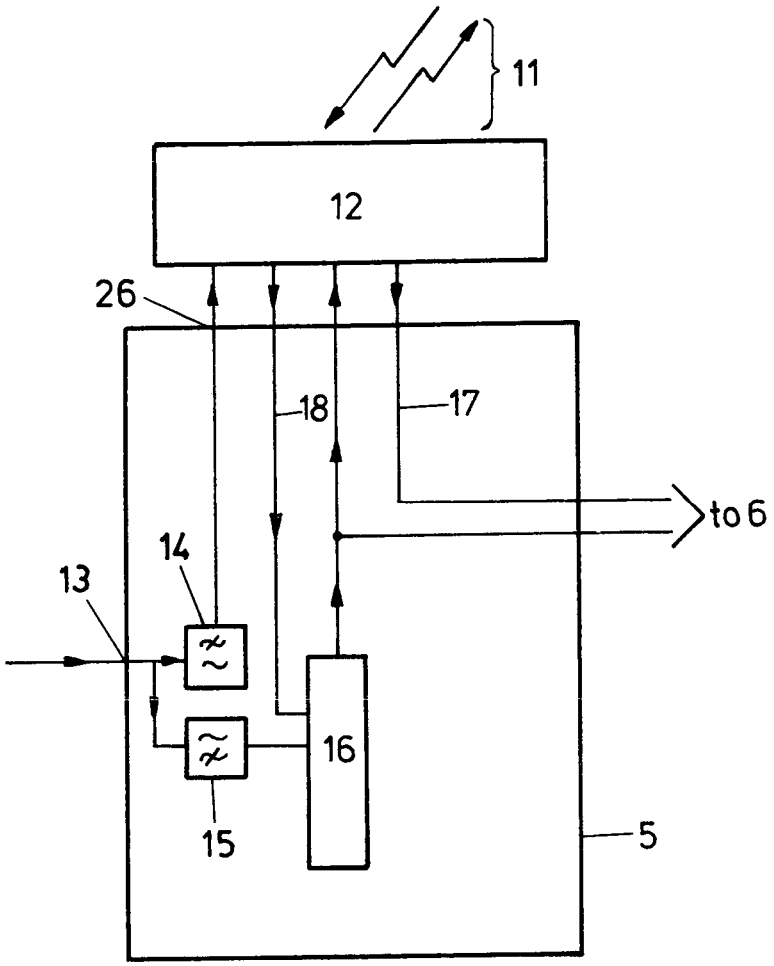
FIG. 5: a block diagram of a variation of the data processing unit of the embodiment of FIG. 4.

In the distributed processing embodiment, the complex coherence in one frequency range, e.g. low-frequency, is calculated in one data processing unit 5 in one individual hearing device L, R, (hereinafter "ipsi-lateral") and the complex coherence of a second frequency range, e.g. high frequency, is calculated in the other data processing unit 5 in the other individual hearing device R, L (hereinafter "contra-lateral"). The definition of "low" and "high" frequencies is chosen for convenience, e.g. "low" frequencies may be frequencies below 4 kHz and "high" frequencies may be frequencies above 4 kHz. Alternatively the cut-off point may be 2 kHz, for instance. Only one data processing unit 5 is illustrated here, the other being merely a mirror image in terms of frequency ranges, that is to say where high and low frequencies are discussed in terms of the ipsi-lateral hearing device of FIG. 5, the data processing unit 5 in the contra-lateral hearing device should be understood as comprising low and high frequencies respectively. Sound information from A-D converter 3 enters the data processing unit 5 at 13. Low pass filter 14 extracts the low frequencies and output them to transducer 12 at 26. High pass filter 15 extracts the high frequencies and outputs them to data processing subunit 16. High-frequency sound information 18 originating from the contra-lateral hearing device is received by transceiver 12 and is likewise input into the data processing subunit 16. The data processing subunit 16 then calculates the complex coherence for the high-frequency ranges, and outputs them to determination unit 6, and also transmits them via transceiver 12 to the contra-lateral data processing unit 5 in the contra-lateral hearing device. Meanwhile, the opposite frequency range (i.e. low frequencies) has been processed by the data processing unit 5 of the contra-lateral hearing device, and the complex coherence 17 resulting from this processing is transmitted via transceiver 12 to the (ipsi-lateral) data processing unit 5, from where it is output to the determination unit 6. This arrangement is advantageous in that processing is not duplicated in each individual hearing device, however this comes at the cost of requiring to transmit more data in real-time between each hearing device, since the results of the processing to determine the complex coherence in each frequency range must be transmitted to the contra-lateral hearing device. Alternatively, if the complex coherence is calculated in frequency bands, the determination of the complex coherence may be carried out in the frequency domain, with exchange of data from certain FFT bins being exchanged between the two hearing devices in the same manner as above.

Figure 6:
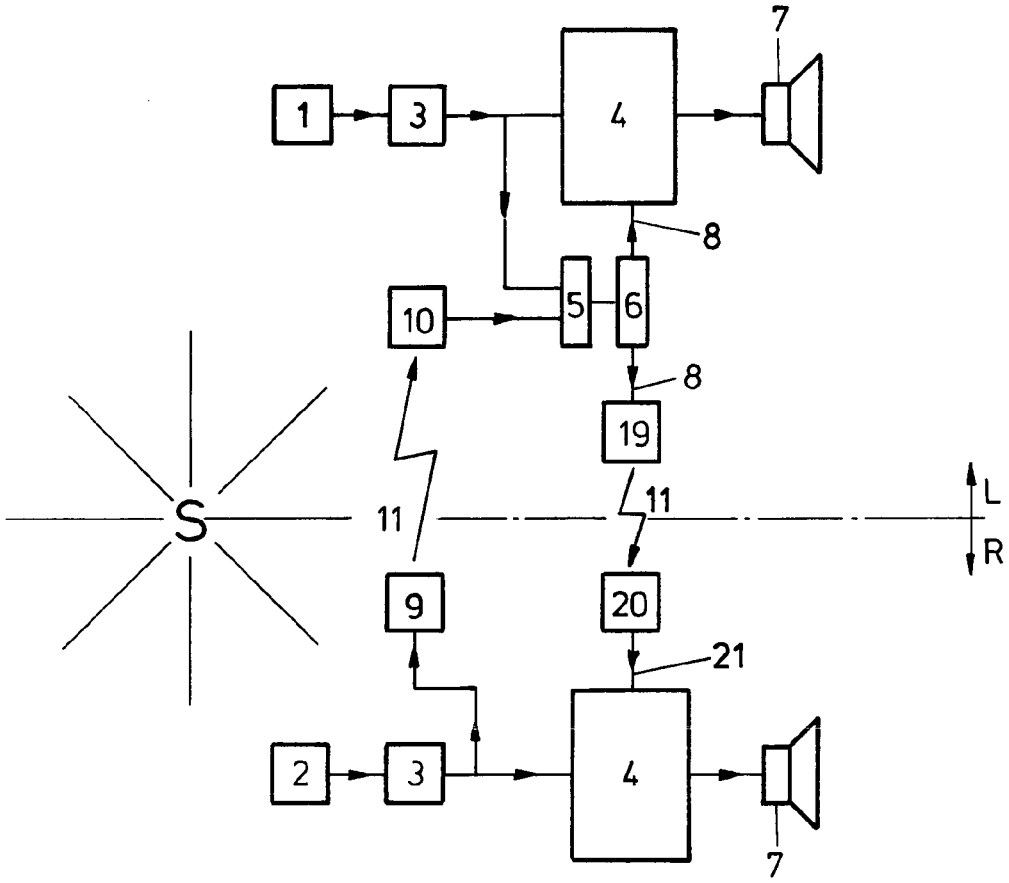
FIG. 6: a block diagram of a fifth, binaural, embodiment

FIG. 6 shows a fourth binaural embodiment, in which all of the data processing to determine the type of acoustic environment is carried out in one hearing device L. This embodiment differs from that of FIG. 2 in that the first hearing device L does not transmit sound information to the second hearing device R, it only receives sound information from the second hearing device R at receiver 10. Data processing unit 5 of the first hearing device L processes thereby sound information data from both hearing devices, and determination unit 6 not only outputs control signals 8 to signal processing unit 4 in the first hearing device, but it also transmits the same signals 8 via the transmitter 19 and the wireless link 11 to receiver 20 on the second hearing device R, where the signals are input into the signal processing unit 4 so as to instruct the signal processing unit 4 to adjust sound processing parameters so as to optimise the wearer's hearing experience as above. It is self-evident that transmitters 9, 19 and receivers 10, 20 can be combined into any convenient number of transceivers. Second hearing device R is therefore not required to perform calculations so as to determine the sound processing parameters of its signal processing unit 4. This simplifies the second hearing device R, reducing its costs and reducing power consumption.

The following describes one variant of how the complex coherence is used to define the acoustic environment. (n.b.: Although the complex coherence in the following is given as $\gamma_{PU}$, the same relations hold for $\gamma_{PP}$ as appropriate):

Inside of Car

Inside a car, at low frequencies (<300 Hz) the coherence is imaginary ($|\angle\gamma_{PU}|>60°$, $\mathrm{Im}\{\gamma_{PU}\}>0.75$) and at high frequencies (>2 kHz) it is real ($|\angle\gamma_{PU}|<30°$) and close to zero ($|\gamma_{PU}+0.2$)

Quiet at Home Vs. Quiet in Nature

In a quiet situation in nature, the real value of the coherence approaches unity, ($|\angle\gamma_{PU}|<30°$, $\mathrm{Re}\{\gamma_{PU}\}>0.75$). In a quiet situation at home, the real value of the coherence is close to zero ($|\angle\gamma_{PU}<30°$, $\mathrm{Re}\{\gamma_{PU}\}<0.2$). This is true at all frequencies where the source signals have a certain signal power that is typical for a quiet situation.

TV at Home

When watching TV, the small distance to the sound source (the TV) results in a high direct-to-reverberant ratio ($|\angle\gamma_{PU}|<30°$, $\mathrm{Re}\{\gamma_{PU}\}>0.75$). The lower frequency above which this holds is dependent on the room size but is typically not higher than 200 Hz.

In addition to determining the acoustic environments, the complex coherence can also be used to help in determining various other useful parameters:

Number of Speakers

The sound field due to a low number of discrete sources positioned at various angles leads to a decrease of the real value of the coherence from unity but a distinction from a diffuse field can be made due to spectral/temporal orthogonality of the sources or due to different dynamics of the coherence values. Combining the coherence estimate further with the SNR estimated from classical features further helps in the distinction. For example, a low SNR and high coherence can only be achieved with a low number (<8) of sources ($|\angle\gamma_{PU}|<30°$, $|\gamma_{PU}|$ varies according to the number of sources). This is true at all frequencies where the source signals have sufficient signal power above the noise floor.

SNR (Signal-to-Noise Ratio) Estimation

The SNR in a mixed direct/diffuse field situation is related by a non-linear function to the real value of the coherence: ($|\angle\gamma_{PU}<30°$, $|\gamma_{PU}|$ varies according to SNR). This is true at all frequencies where the source signals have sufficient signal power above the noise floor.

Detection of Reverberant Environments

Reverberant environments can be detected by calculating the coherence either with (i) different FFT (Fast Fourier Transform) block sizes, i.e. time frames, (ii) PSD (Power Spectral Density) averaging with different averaging constants or (iii) PSD averaging over different number of FFT bins. In either case the transition from unity (long FFT block size or short averaging constants with respect to reverberation time) to the asymptotic direct-to-reverberant energy ratio (DRR) value (small FFT block size or long averaging constants with respect to reverberation time) depends on the reverberation time ($|\angle\gamma_{PU}<30°$, $|\gamma_{PU}|$ varies with the FFT block size or averaging time constant). This is true at all frequencies where the source signals have sufficient signal power above the noise floor.

Although the invention has been explained in terms of specific embodiments, these are not to be constituted as limiting the invention, which is solely defined by the appended claims, incorporating all variations falling within their scope.

What is claimed is:

1. Method of controlling a hearing instrument comprising at least one hearing device (L, R), the method comprising the steps of:

receiving sound information with at least a first transducer (1) and a second transducer (2);

processing said sound information so as to extract at least one characteristic feature of the sound information;

determining a type of acoustic environment selected from a plurality of predefined classes of acoustic environment based on the at least one extracted characteristic feature;

adjusting sound processing parameters based on the determined type of acoustic environment, the sound processing parameters defining an input/output behavior of the at least one hearing device;

characterised in that said at least one characteristic feature comprises a complex coherence calculated based on the sound information received by the first transducer and the second transducer.

2. Method according to claim 1, wherein the first transducer (1) is a pressure microphone and the second transducer (2) is a particle velocity transducer, the first and second transducers being situated in the same hearing device (L, R) in an acoustically coincident manner, and wherein the complex coherence is the complex coherence between the sound pressure measured by the pressure microphone and the particle velocity measured by the particle velocity transducer.

3. Method according to claim 2, wherein the particle velocity transducer (2) is a pressure gradient microphone or a hot wire particle velocity transducer.

4. Method according to claim 1, wherein the first transducer (1) is a first pressure microphone and the second transducer (2) is a second pressure microphone.

5. Method according to claim 4, wherein the first pressure microphone (1) and the second pressure microphone (2) are situated in the same hearing device (L, R), and wherein the complex coherence is the complex coherence between the mean sound pressure measured by the pressure microphones (1, 2) and the particle velocity is calculated based on the sound pressure measured by the pressure microphones (1, 2).

6. Method according to claim 4, wherein the first pressure microphone (1) is situated in a first hearing device (L) and the second pressure microphone (2) is situated in a second hearing device (R), and wherein the complex coherence is the complex coherence between the sound pressure measured by the first pressure microphone (1) and the sound pressure measured by the second pressure microphone (2).

7. Method according to claim 6, wherein said first hearing device (L) and said second hearing device (R) each send and/or receive signals relating to the received sound information to/from the other of the first hearing device and the second hearing device.

8. Method according to claim 6, wherein data is mutually exchanged between a first processing unit (4, 5, 6) in the first hearing device (L) and a second processing unit (4, 5, 6) in the second hearing device (R).

9. Method according to claim 6, wherein digitised signals corresponding to sound information received at each microphone (1, 2) are mutually exchanged between each hearing device (L, R), said signals corresponding to sound information in either the time domain or frequency domain.

10. Method according to claim 6, wherein digitised signals corresponding to sound information at one microphone (1; 2) are transmitted from the second hearing device (R) to the first hearing device (L), and signals corresponding to commands for adjusting sound process parameters are transmitted from the first hearing device (L) to the second hearing device (R).

11. Method according to claim 7, wherein the sound information processed by the first hearing device (L) is situated in a first frequency band and the sound information processed by the second hearing device (R) is situated in a second frequency band, wherein each hearing device (L, R) transmits the sound information required by the contralateral hearing device (R, L), and after processing, the result of said processing is transmitted back to the ipsi-lateral hearing device (L, R).

12. Method according to claim 1, wherein the characteristic features further comprise at least one of: signal-to-noise ratio in at least one frequency band; signal-to-noise ratio in a plurality of frequency bands; noise level in at least one frequency band; noise level in a plurality of frequency bands; direction of arrival of noise signals; direction of arrival of useful signal; signal level; frequency spectra; modulation frequencies; modulation depth; zero crossing rate; onset; center of gravity; RASTA, etc.

13. Method according to claim 1, wherein the complex coherence is calculated in a single frequency band or in a plurality of frequency bands.

14. Method according to claim 13, wherein each of said frequency bands has a linear resolution of between 50 Hz and 250 Hz or a psychoacoustically-motivated non-linear resolution.

15. Hearing instrument comprising:

at least one hearing device (L, R);

at least a first transducer (1) and a second transducer (2);

at least one processing unit (4, 5, 6) operationally connected to the first transducer (1) and the second transducer (2);

an output transducer (7) operationally connected to an output of the at least one processing unit (L, R);

wherein the at least one processing unit (4, 5, 6) comprises:

means (5) for processing sound information received by the first transducer and the second transducer so as to extract at least one characteristic feature of the sound information;

means (6) for determining a type of acoustic environment selected from a plurality of predefined classes of acoustic environment based on the at least one extracted characteristic feature;

means for adjusting sound processing parameters based on the determined type of acoustic environment, the sound processing parameters defining an input/output behavior of the at least one hearing device (L, R);

characterised in that said at least one characteristic feature comprises a complex coherence calculated based on the sound information received by the first transducer and the second transducer.

16. Hearing instrument according to claim 15, wherein the first transducer (1) is a pressure microphone and the second transducer (2) is a particle velocity transducer, both the first transducer (1) and the second transducer (2) being situated in the same hearing device (L, R) in an acoustically-coincident manner, and wherein the complex coherence is the complex coherence between the sound pressure measured by the pressure microphone (1) and the particle velocity measured by the particle velocity transducer (2).

17. Hearing instrument according to claim 16, wherein the particle velocity transducer (2) is a pressure gradient microphone or a hot wire particle velocity transducer.

18. Hearing instrument according to claim 16, wherein the first transducer (1) is a first pressure microphone and the second transducer (2) is a second pressure microphone.

19. Hearing instrument according to claim 18, wherein the first pressure microphone (1) and the second pressure microphone (2) are situated in the same hearing device (L; R), and wherein the complex coherence is the complex coherence between the mean sound pressure measured by the pressure microphones (1, 2) and the particle velocity calculated based on the sound pressure measured by the pressure microphones (1, 2).

20. Hearing instrument according to claim 18, wherein the first pressure microphone (1) is situated in a first hearing device (L) and the second pressure microphone (2) is situated in second hearing device (R), and wherein the complex coherence is the complex coherence between the sound pressure measured by the first pressure microphone (1) and the sound pressure measured by the second pressure microphone (2).

21. Hearing instrument according to claim 20, wherein said first (L) and second (R) hearing devices each comprise at least one of a transmitter (9; 19), a receiver (10; 20), or a transceiver (12), adapted to send and/or receive signals to/from the other hearing device.

22. Hearing instrument according to claim 21, wherein the signals relate to the received sound information in either the time domain or the frequency domain.

23. Hearing instrument according to claim 21, wherein the signals relate to data exchanged between a first processing unit (4, 5, 6) in the first device and a second processing unit (4, 5, 6) in the second device.

24. Hearing instrument according to claim 20, wherein the second hearing device (R) is arranged to transmit digitised signals corresponding to sound information at one microphone (2) to the first hearing device (L), and the first hearing device (L) is arranged to transmit signals corresponding to commands for adjusting sound processing parameters to the second hearing device (R), each hearing device (L, R) being arranged to receive signals transmitted by the contra-lateral hearing device (R, L).

25. Hearing instrument according to claim 21, wherein the first hearing device (L) comprises a first processing unit (5) for processing sound information situated in a first frequency band and the second device (R) comprises a processing unit (5) for processing sound information situated in a second frequency band, wherein each hearing device (L, R) is arranged to transmit the sound information required by the contra-lateral hearing device (R, L) via its transmitter or transceiver (12), and after processing, each hearing device (L, R) further being arranged to transmit the result of said processing to the contra-lateral hearing device (R, L) via its transmitter or transceiver (12), each hearing device (L, R) being further arranged to receive the signals transmitted by the contra-lateral hearing device (R, L) by means of its receiver or transceiver (12).

26. Hearing instrument according to claim 15, wherein the characteristic features further comprise at least one of: signal-to-noise ratio in at least one frequency band; signal-to-noise ratio in a plurality of frequency bands; noise level in at least one frequency band; noise level in a plurality of frequency bands; direction of arrival of noise signals; direction of arrival of useful signal; signal level; frequency spectra; modulation frequencies; modulation depth; zero crossing rate; onset; center of gravity, RASTA, etc.

27. Hearing instrument according to claim 15, wherein at least one processing unit (4, 5, 6) is arranged to calculate the complex coherence in a single frequency band or in a plurality of frequency bands.

28. Hearing instrument according to claim 27, wherein each of said frequency bands has a linear resolution of between 50 Hz and 250 Hz or a psychoacoustically-motivated non-linear resolution.

* * * * *